US006280161B1

(12) United States Patent
Seo

(10) Patent No.: US 6,280,161 B1
(45) Date of Patent: Aug. 28, 2001

(54) AIR-TIGHT TYPE RECIPROCATING COMPRESSOR

(75) Inventor: Seung-Don Seo, Kwangju (KR)

(73) Assignee: Samsung Kwangju Electronics Co., Ltd. (KR)

( * ) Notice: Subject to any disclaimer, the term of this patent is extended or adjusted under 35 U.S.C. 154(b) by 0 days.

(21) Appl. No.: 09/528,247

(22) Filed: Mar. 17, 2000

(30) Foreign Application Priority Data

Dec. 8, 1999 (KR) ..... 99-55929

(51) Int. Cl.[7] ..... F04B 11/00
(52) U.S. Cl. ..... 417/540; 417/312
(58) Field of Search ..... 417/540, 312; 181/403

(56) References Cited

U.S. PATENT DOCUMENTS 2,074,932 * 3/1937 Mittendorf et al. ..... 417/312
5,173,034 * 12/1992 Riffe ..... 417/312
5,435,700 * 7/1995 Park ..... 417/312
6,155,067 * 12/2000 Ono et al. ..... 417/312 X
6,176,688 * 1/2001 Collings et al. ..... 417/312

* cited by examiner

*Primary Examiner*—Charles G. Freay
*Assistant Examiner*—David J. Torrente
(74) *Attorney, Agent, or Firm*—Burns, Doane, Swecker & Mathis

(57) ABSTRACT

Disclosed is an air-tight type reciprocating compressor which can decrease discharge pulsation to reduce the vibration of a discharge line as well as to reduce an overall value in a high-frequency band as a problem frequency. The compressor, which has case members, each of which being coupled on the lower parts of a block, for receiving discharge refrigerant flowing through at least two discharge holes on the block, a connecting pipe which is adapted to communicate with the case members, and a discharge pipe which is connected to one of the case members, includes one of the at least two discharge holes having the larger diameter by at least 50–70% than that of the other which is installed on the case member to which the discharge pipe is connected.

2 Claims, 2 Drawing Sheets

AIR-TIGHT TYPE RECIPROCATING COMPRESSOR

BACKGROUND OF THE INVENTION

1. Field of the Invention

The present invention relates to an air-tight type reciprocating compressor, and more particularly, to an air-tight type reciprocating compressor which can decrease discharge pulsation to reduce vibration on a discharge line as well as an overall value in a high-frequency band as a problem frequency.

2. Discussion of Related Art

Generally, a compressor is used to compress a refrigerant gas at a low temperature and low pressure state into gas at a high temperature and high pressure state. Particularly, the present invention is directed to an air-tight type compressor which is reciprocated by means of a piston.

The air-tight type reciprocating compressor is generally constructed in such a manner that a crankshaft is rotatably installed by means of a magnetic field formed on a stator and rotor within a body that maintains the air-tightness in the interior of the compressor and forms the external appearance thereof, and a piston which is reciprocated on a block, is connected to the one end of the crankshaft and discharges the pressurized refrigerant by the reciprocating movement thereof to a discharge pipe.

An example of conventional air-tight type reciprocating compressors is shown in FIG. 3. In construction, a case member 20, which has a discharge chamber where a discharging refrigerant is received, is coupled by means of a coupling means 30 such as a bolt to the one side of a pair of protrusions 11 formed on the lower part of a block 10, and a discharge pipe 40 is connected to the case member 20 to discharge the refrigerant to a condenser (not shown).

In more detail, on the block 10, there are provided a cylinder 12 along with a piston (not shown) is guided communicates with a tight surface 13 on which a valve plate (not shown) is installed and a discharge hole 14 which is adapted to discharge the pressurized refrigerant by the movement to the cylinder 12 to the discharge pipe 40 via the case member 20 coupled with the protrusions 11 by means of the coupling means 30.

A reference numeral '15' denotes a screw for securing each of the valve plate, a gasket (not shown) and a cylinder head (not shown) on the block 10.

If the piston moves towards the tight surface 13 and reaches a top dead center, the compressed refrigerant gas pushes the discharge valve for blocking the discharge hole of the valve plate and is received in the discharge chamber of the cylinder head. Next, the compressed gas which has been received in the discharge chamber flows into the case member 20 via the discharge hole 14 of the block 10 and is concurrently supplied to the condenser via the discharge pipe 40, a guide tube (not shown) and a discharge tube (not shown).

In the conventional air-tight type reciprocating compressor, however, there occurs a problem that as the discharge refrigerant gas flows along a single path formed on the block 10, the pulsation of the discharge pressure becomes increase. Of course, this is not solved even though the shape or path of the discharge pipe 40 is changed.

In addition, there occurs a problem that the increment of the discharge pulsation causes recent refrigerator models using the compressor to rise noise and vibration values. This should be of course improved.

Due to the increment of the pulsation of the discharge refrigerant gas, the discharge gas is directly supplied via a connecting pipe of the compressor with a refrigerator to the refrigerator side, thus to vibrate a cabinet of the refrigerator. Of course, this increases the amount of the vibration and noise generated from the refrigerator.

SUMMARY OF THE INVENTION

Accordingly, the present invention is directed to an air-tight type reciprocating compressor that substantially obviates one or more of the problems due to limitations and disadvantages of the related arts.

An object of the invention is to provide an air-tight type reciprocating compressor which has at least two discharge paths each having a predetermined size to thereby decrease the discharge pulsation, thereby allowing the vibration on the discharge line to be reduced and an overall value in a high-frequency band as a problem frequency to be lowered, such that it can reduce the noise and vibration caused due to the pressure pulsation upon refrigerant discharging.

To accomplish this and other objects of the present invention, there is provided an air-tight type reciprocating compressor having case members, each of which is coupled on the lower parts of a block, for receiving discharge refrigerant flowing through at least two discharge holes on the block, a connecting pipe which is adapted to communicate with the case members, and a discharge pipe which is connected to one of the case members, the compressor including: one of the at least two discharge holes having the larger diameter by at least 50–70% than that of the other installed on the case member to which the discharge pipe is connected.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings.

DETAILED DESCRIPTION OF PREFERRED EMBODIMENT

Reference will now be made in detail to the preferred embodiments of the present invention, examples of which are illustrated in the accompanying drawings.

Figure 1:
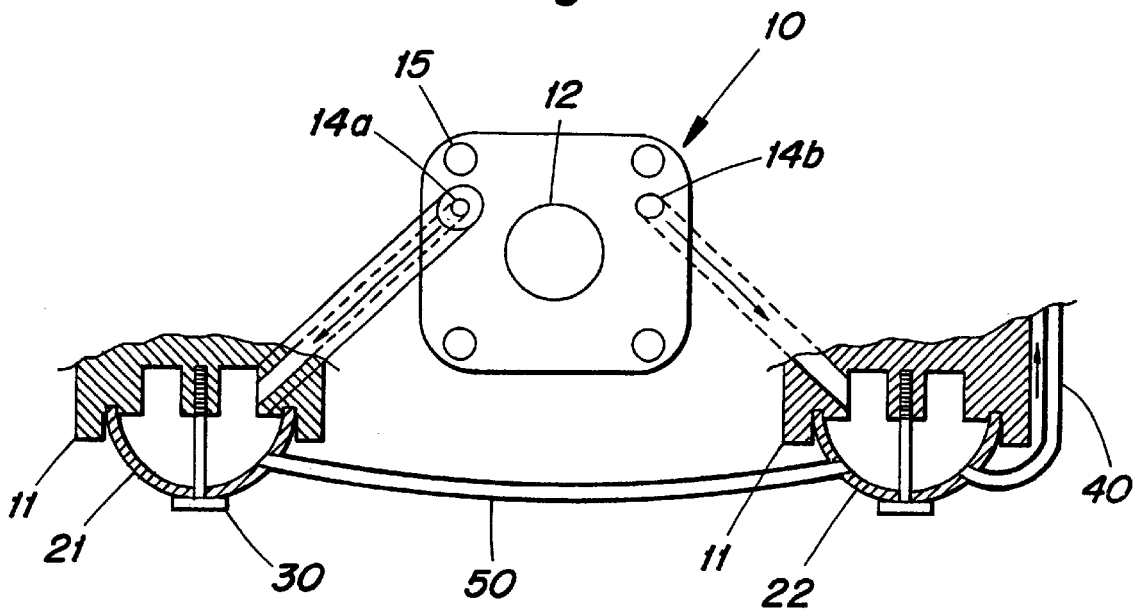
FIG. 1 is an exemplary view illustrating the construction of the air-tight type reciprocating compressor according to the present invention.
Figure 2:
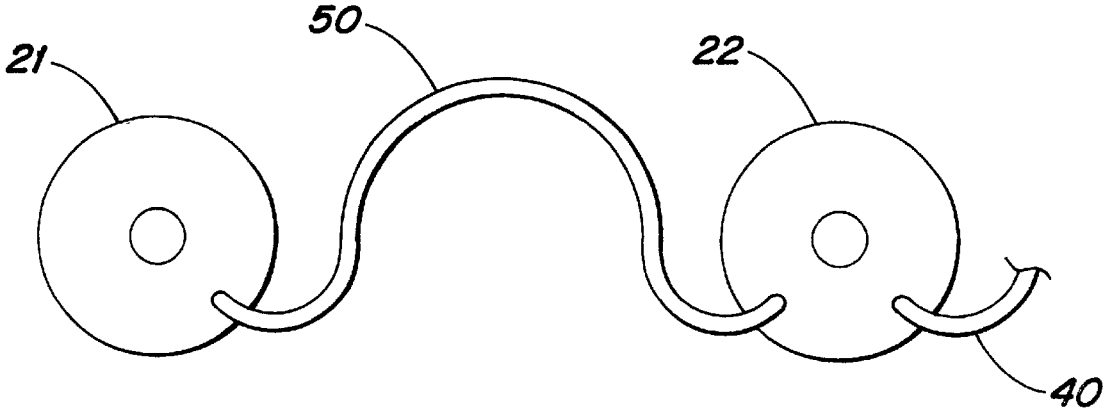
FIG. 2 is a schematic plan view illustrating the case members, the connecting pipe and the discharge pipe of FIG. 1.
Figure 3:
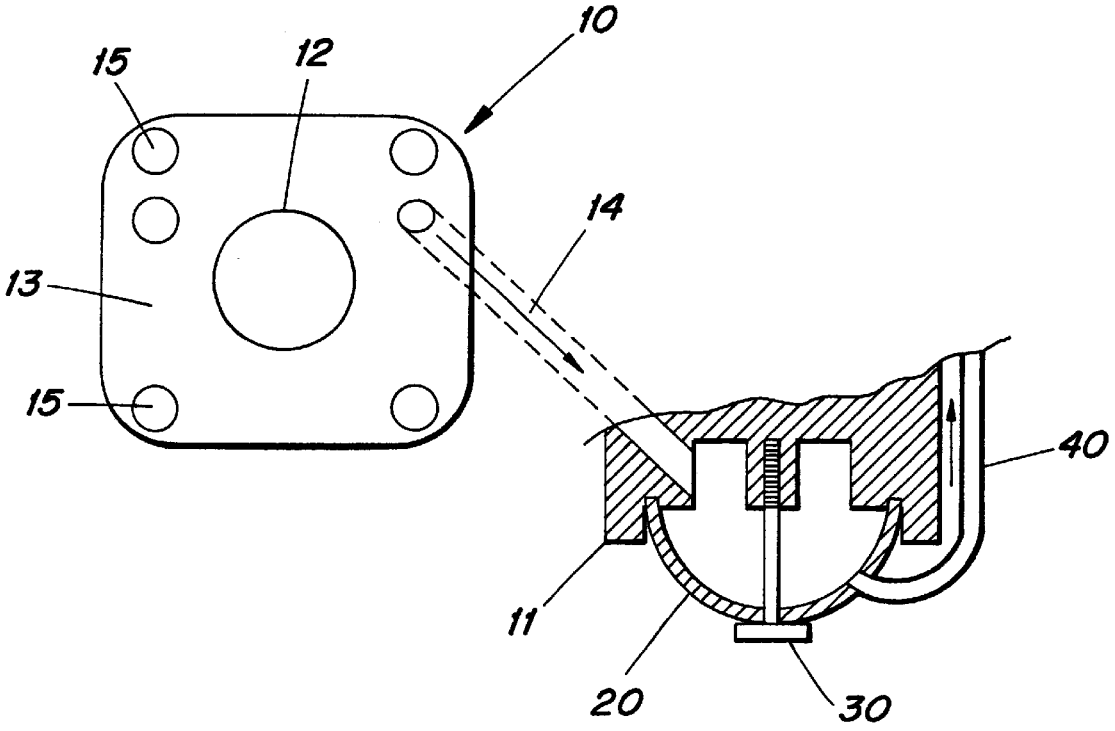
Fig. 3 PRIOR ART
FIG. 3 is an exemplary view illustrating the construction of a conventional air-tight type reciprocating compressor.

FIG. 1 is an exemplary view illustrating the construction of the air-tight type reciprocating compressor according to the present invention. FIG. 2 is a schematic plan view illustrating the case members, the connecting pipe and the discharge pipe of FIG. 1. For the brevity of the description, an explanation of the same parts as FIG. 3 will be avoided.

As shown in FIGS. 1 and 2, the air-tight type reciprocating compressor according to the present invention is constructed in such a manner that each of a pair of case members 21 and 22 has a discharge chamber where the discharging refrigerant is received and is coupled by means of a coupling means 30 such as a bolt to each of a pair of protrusions 11 formed on the lower part of a block, a connecting pipe 50 is installed to communicate with the case members 21 and 22, and a discharge pipe 40 is connected to one of the case members 21 and 22 to discharge the compressed refrigerant gas to a condenser (not shown).

In more detail, on the block 10 there are provided a cylinder 12 along with a piston (not shown) is guided communicates with a tight surface 13 on which a valve plate (not shown) is installed and discharge holes 14*a* and 14*b* which are adapted to discharge the pressurized refrigerant by the movement to the cylinder 12 in the order of the connecting pipe 50, one of the case members 21 and 22 and the discharge pipe 40, via one of the case members 21 and 22 coupled by means of the coupling means 30 with the protrusions 11, and in the order of one of the case members 21 and 22 and the discharge pipe 40.

In the preferred embodiment of the present invention, the discharge hole 14*a* is formed to discharge the part of pressurized refrigerant by the movement to the cylinder 12 in the order of the connecting pipe 50, the case member 22 and the discharge pipe 40 via the case member 21 coupled by means of the coupling means 30 with the protrusions 11. On the other hand, the discharge hole 14*b* is formed to discharge the part of pressurized refrigerant by the movement to the cylinder 12 in the order of the case member 22 and the discharge pipe 40.

In this case, under the conditions where the discharge hole 14*a* has the larger diameter by at least 50–70% than that of the discharge hole 14*b*, we can obtain an optimal test result where the discharge pulsation is decreased, thereby allowing the vibration on the discharge line to be reduced and an overall value in a high-frequency band as a problem frequency to be lowered. When compared with the conventional compressor having a single case member, the test result values of the present invention are as follows:

TABLE 1

| DD143B, Q DATA | | |
|---|---|---|
| | PRIOR ART | THE PRESENT INVENTION |
| 220/60 Hz | | |
| Cooling Force | 121.57 | 125.90 |
| Pressure | 98.00 | 98.48 |
| Efficiency | 1.24 | 1.28 |
| Noise | 44.5 | 41.5 |
| 220/50 Hz | | |
| Cooling Force | 98.86 | 104.26 |
| Pressure | 84.00 | 84.98 |
| Efficiency | 1.18 | 1.23 |
| Noise | 43.0 | 40.5 |

A most efficient test result in the above table [1] can be obtained in the conditions that the diameter of the discharge hole 14*a* is preferably 2.0–6.0 mm and that of the discharge hole 14*b* is preferably 2.86–9.0 mm.

Of course, the path grooves of the valve plate and gasket contacted on the tight surface 13 of the block 10 have the same diameter as the discharge holes 14*a* and 14*b*.

On the other hand, the diameter of the connecting pipe 50 can be adjusted in accordance with the diameters of the discharge holes 14*a* and 14*b*, for decrement of the discharge pulsation.

If the piston moves towards the tight surface 13 and reaches a top dead center, the compressed refrigerant gas pushes the discharge valve for blocking the discharge hole of the valve plate and is received in the discharge chamber of the cylinder head. Next, the part of the compressed gas which has been received in the discharge chamber discharges, via the discharge hole 14*a*, in the order of the case member 21 coupled by means of the coupling means 30 with the protrusions 11, the connecting pipe 50, the case member 22 and the discharge pipe 40. The remaining part thereof discharges, via the discharge hole 14*b*, in the order of the case member 22 and the discharge pipe 40.

When the discharge hole 14*a* is adapted to have the larger diameter by at least 50–70% than that of the discharge hole 14*b* to which the case member 22 having the discharge pipe 40 is installed, the discharge pulsation is decreased, such that the vibration of the discharge line can be reduced and an overall value in a high-frequency band can be lowered.

The most efficient test result in the table [1] can be obtained in the conditions that the diameter of the discharge hole 14*a* is preferably 2.0–6.0 mm and that of the discharge hole 14*b* is preferably 2.86–9.0 mm, such that it can be obviously noted that the discharge hole 14*a* is adapted to have the larger diameter by at least 50–70% than that of the discharge hole 14*b*.

At this time, the trouble probability caused due to the pressure pulsation can be lowered to thereby reduce the vibration and noise undesirably generated from the refrigerator.

As discussed above, the air-tight type reciprocating compressor according to the present invention has at least two discharge paths each having a predetermined size to thereby decrease the discharge pulsation, such that the vibration of the discharge line can be reduced and an overall value in a high-frequency band as a problem frequency can be lowered.

It will be apparent to those skilled in the art that various modifications and variations can be made in an air-tight type reciprocating compressor of the present invention without departing from the spirit or scope of the invention. Thus, it is intended that the present invention cover the modifications and variations of this invention provided they come within the scope of the appended claims and their equivalents.

What is claimed is:

1. An air-tight type reciprocating compressor having case members, each of which being coupled on the lower part of a block, for receiving discharge refrigerant flowing through at least two discharge holes discharge holes on said block, a connecting pipe which is adapted to communicate with said case members, and a discharge pipe which is connected to one of said case members, said compressor comprising:

one of said at least two discharge holes having the larger diameter by at least 50–70% than that of the other which is installed on said case member to which said discharge pipe is connected.

2. The compressor as claim 1, wherein said discharge hole having the smaller diameter of said at least two discharge holes has the diameter of 2.0–6.0 mm.

* * * * *